US009126066B2

(12) United States Patent
Gamble et al.

(10) Patent No.: US 9,126,066 B2
(45) Date of Patent: Sep. 8, 2015

(54) SMART CONNECTOR FOR INTEGRATION OF A FOAM PROPORTIONING SYSTEM WITH FIRE EXTINGUISHING EQUIPMENT

(75) Inventors: Jonathan Gamble, Taylors Falls, MN (US); Harold McCabe, Roseville, MN (US)

(73) Assignee: Fire Research Corp., Nesconset, NY (US)

( * ) Notice: Subject to any disclaimer, the term of this patent is extended or adjusted under 35 U.S.C. 154(b) by 1038 days.

(21) Appl. No.: 13/082,241

(22) Filed: Apr. 7, 2011

(65) Prior Publication Data

US 2012/0012345 A1 Jan. 19, 2012

Related U.S. Application Data

(60) Provisional application No. 61/322,091, filed on Apr. 8, 2010.

(51) Int. Cl.
*A62C 35/00* (2006.01)
*A62C 5/02* (2006.01)

(52) U.S. Cl.
CPC ..... *A62C 5/02* (2013.01); *Y10T 29/49002* (2015.01)

(58) Field of Classification Search
CPC ..... A62C 5/00; A62C 5/02; A62C 37/04
USPC ..... 169/19, 16, 17, 37, 43, 46, 60; 239/67, 239/69
See application file for complete search history.

(56) References Cited

U.S. PATENT DOCUMENTS

| | | | |
|---|---|---|---|
| 4,727,475 | A | 2/1988 | Kiremidjian |
| 5,472,347 | A | 12/1995 | Nordenstrom et al. |
| 5,575,686 | A | 11/1996 | Noschese |
| 5,640,594 | A | 6/1997 | Gibson et al. |
| 5,675,804 | A | 10/1997 | Sidik et al. |
| 5,748,980 | A | 5/1998 | Lipe et al. |
| 5,765,644 | A | 6/1998 | Arvidson et al. |
| 5,991,842 | A | 11/1999 | Takayama |
| 5,995,624 | A | 11/1999 | Fielder et al. |
| 5,999,989 | A | 12/1999 | Patel |
| 6,003,097 | A | 12/1999 | Richman et al. |
| 6,154,836 | A | 11/2000 | Dawson, III et al. |
| 6,240,477 | B1 | 5/2001 | Erkinger et al. |
| 6,357,532 | B1 | 3/2002 | Laskaris |
| 6,363,436 | B1 | 3/2002 | Hagy et al. |
| 6,424,974 | B1 | 7/2002 | Cotner et al. |
| 6,523,073 | B1 | 2/2003 | Kammer et al. |
| 6,598,095 | B2 | 7/2003 | Peterson |
| 6,651,080 | B1 | 11/2003 | Liang et al. |
| 6,731,858 | B2 | 5/2004 | Sato |
| 6,766,863 | B2 | 7/2004 | Arvidson et al. |
| 7,071,972 | B2 | 7/2006 | Koyama |

(Continued)

*Primary Examiner* — Davis Hwu
(74) *Attorney, Agent, or Firm* — Quarles & Brady LLP

(57) ABSTRACT

Embodiments of the invention provide a fire extinguishing system including an electronic control unit in communication with a software library, a foam proportioning system including foam proportioning equipment, and a smart connector. The smart connector includes a controller, and the smart connector is connected to the foam proportioning equipment. The controller automatically initiates an authentication procedure when the smart connector is connected to the electronic control unit. The controller causes the electronic control unit to automatically unlock at least one routines in the software library after the authentication procedure is complete to enable control of the foam proportioning equipment.

12 Claims, 8 Drawing Sheets

(56) References Cited

U.S. PATENT DOCUMENTS

| | | | |
|---|---|---|---|
| 7,181,609 | B2 | 2/2007 | Connor et al. |
| 7,231,513 | B1 | 6/2007 | Eydelberg |
| 7,272,665 | B2 | 9/2007 | Yamada et al. |
| 7,318,483 | B2 | 1/2008 | Arvidson et al. |
| 7,657,650 | B2 | 2/2010 | Samanta et al. |
| 7,712,542 | B2 * | 5/2010 | Munroe ..... 169/14 |
| 2004/0050556 | A1 | 3/2004 | Baker et al. |
| 2005/0155776 | A1 | 7/2005 | Arvidson et al. |
| 2005/0172173 | A1 | 8/2005 | Page |

* cited by examiner

SMART CONNECTOR FOR INTEGRATION OF A FOAM PROPORTIONING SYSTEM WITH FIRE EXTINGUISHING EQUIPMENT

CROSS-REFERENCE TO RELATED APPLICATIONS

This application claims the benefit of United States Provisional Patent Application Ser. No. 61/322,091, filed Apr. 8, 2010, and entitled "Smart Connector for Integration of a Foam Proportioning System with Fire Extinguishing Equipment," which is hereby incorporated by reference.

BACKGROUND

Foam proportioning systems are often added to the existing fire extinguishing equipment on fire trucks. The foam proportioning systems include controllers that must communicate with the existing electronic control unit (ECU) of the fire truck. Conventionally, when a new foam proportioning system is installed on a fire truck, a system operator must manually install new software to operate the controller of the foam proportioning system in conjunction with, the existing ECU of the fire truck. The new controller of the foam proportioning system must be properly integrated with the ECU of the fire truck in order to guarantee safe and reliable operation of the fire extinguishing equipment. With conventional installation methods, trained system operators must thoroughly test the foam proportioning system once installed on the fire truck, which involves time-consuming debugging. As foam proportioning systems become more complex, system operators must be given more extensive training and it takes longer for the foam proportioning system to be installed on the fire truck, resulting in additional down-time before the fire truck can be put back into service.

SUMMARY

Some embodiments of the invention provide a fire extinguishing system including fire extinguishing equipment, a foam proportioning system, and a smart connector. The fire extinguishing equipment includes an electronic control unit and a software library. The foam proportioning system includes a controller, and the smart connector includes a micro-controller. The micro-controller automatically initiates an authentication procedure when the controller of the foam proportioning system is connected to the electronic control unit of the fire extinguishing equipment. The micro-controller causes the electronic control unit to automatically unlock routines in the software library after the authentication procedure is complete.

Some embodiments of the invention provide a method of installing a foam proportioning system in a fire extinguishing system using a smart connector. The method includes connecting the smart connector to an electronic control unit of the fire extinguishing system. The method can also include sending a query from the electronic control unit to the smart connector, and sending a response to the query from the smart connector to the electronic control unit including an authorization procedure and configuration data for the foam proportioning system. The method can further include identifying the foam proportioning system with the electronic control unit based on the response, and sending an unlock command from the electronic control unit to the smart connector if the response is valid. In addition, the method can include processing the unlock command with the smart connector, sending an unlock response and an unlock status from the smart connector to the electronic control unit, and unlocking at least a portion of the software library in the electronic control unit.

Yet additional embodiments of the invention provide a fire extinguishing system including an electronic control unit in communication with a software library, a foam proportioning system including foam proportioning equipment, and a smart connector. The smart connector includes a controller, and the smart connector is connected to the foam proportioning equipment. The controller automatically initiates an authentication procedure when the smart connector is connected to the electronic control unit. The controller causes the electronic control unit to automatically unlock one or more routines in the software library after the authentication procedure is complete to enable control of the foam proportioning equipment.

DESCRIPTION OF THE DRAWINGS

Embodiments of the present invention will become more apparent from the detailed description set forth below when taken in conjunction with the drawings, in which like elements bear like reference numerals.

DETAILED DESCRIPTION

The following discussion is presented to enable a person skilled in the art to make and use embodiments of the invention. Various modifications to the illustrated embodiments will be readily apparent to those skilled in the art, and the generic principles herein can be applied to other embodiments and applications without departing from embodiments of the invention. Thus, embodiments of the invention are not intended to be limited to embodiments shown, but are to be accorded the widest scope consistent with the principles and features disclosed herein. The following detailed description is to be read with reference to the figures. The figures depict selected embodiments and are not intended to limit the scope of embodiments of the invention. Skilled artisans will recognize the examples provided herein have many useful alternatives and fall within the scope of embodiments of the invention.

Figure 6:
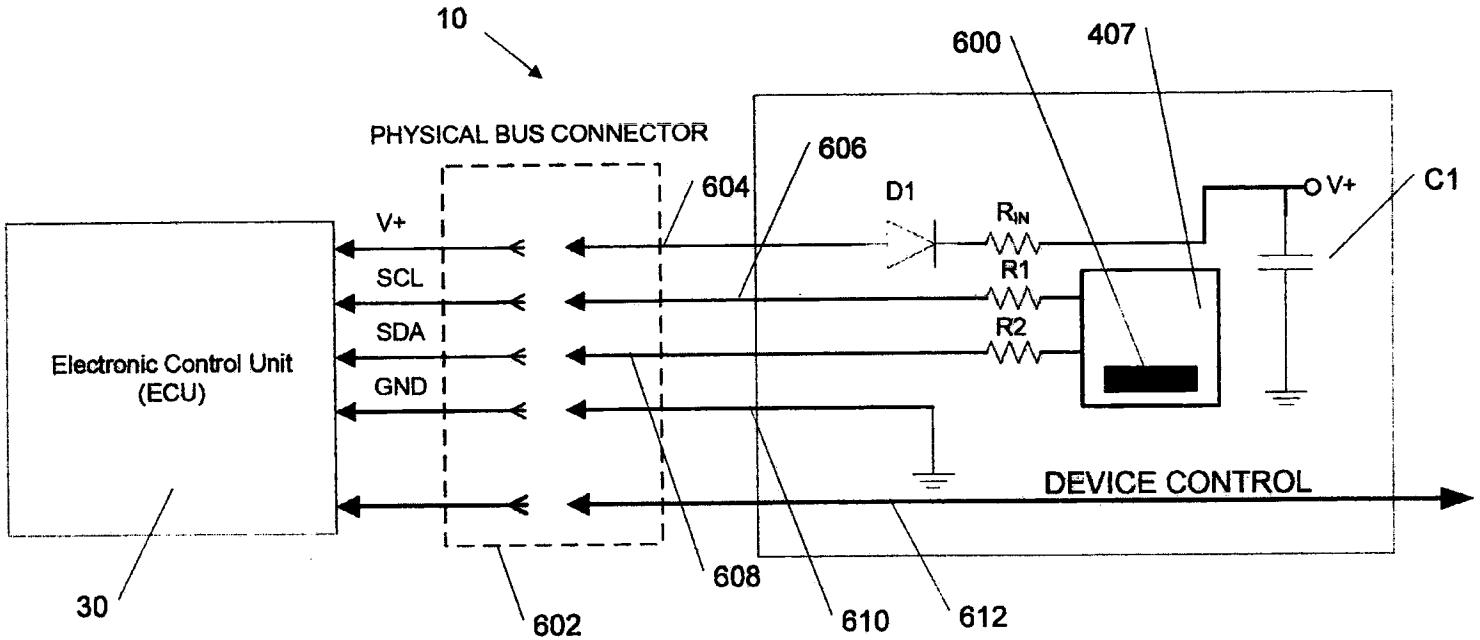
FIG. 6 is an electrical schematic for the smart connector of FIG. 1 according to one embodiment of the invention.

The following description refers to elements or features being "connected" or "coupled" together. As used herein, unless expressly stated otherwise, "connected" means that one element/feature is directly or indirectly connected to another element/feature, and not necessarily mechanically. Likewise, unless expressly stated otherwise, "coupled" means that one element/feature is directly or indirectly coupled to another element/feature, and not necessarily mechanically. Thus, although the schematics shown in FIGS. 1 and 6 depict one example arrangement of processing elements, additional intervening elements, devices, features, or components may be present in an actual embodiment.

The invention may be described herein in terms of functional and/or logical block components and various processing steps. It should be appreciated that such block components may be realized by any number of hardware, software, and/or firmware components configured to perform the specified functions. For example, an embodiment may employ various integrated circuit components, e.g., memory elements, digital signal processing elements, logic elements, look-up tables, etc., which may carry out a variety of functions under the control of one or more microprocessors or other control devices.

In accordance with the practices of persons skilled in the art of computer programming, the present disclosure may be described herein with reference to symbolic representations of operations that may be performed by the various computing components, modules, or devices. Such operations are sometimes referred to as being computer-executed, computerized, software-implemented, or computer-implemented. It will be appreciated that operations that are symbolically represented include the manipulation by the various microprocessor devices of electrical signals representing data bits at memory locations in the system memory, as well as other processing of signals. The memory locations where data bits are maintained are physical locations that have particular electrical, magnetic, optical, or organic properties corresponding to the data bits.

Figure 1:
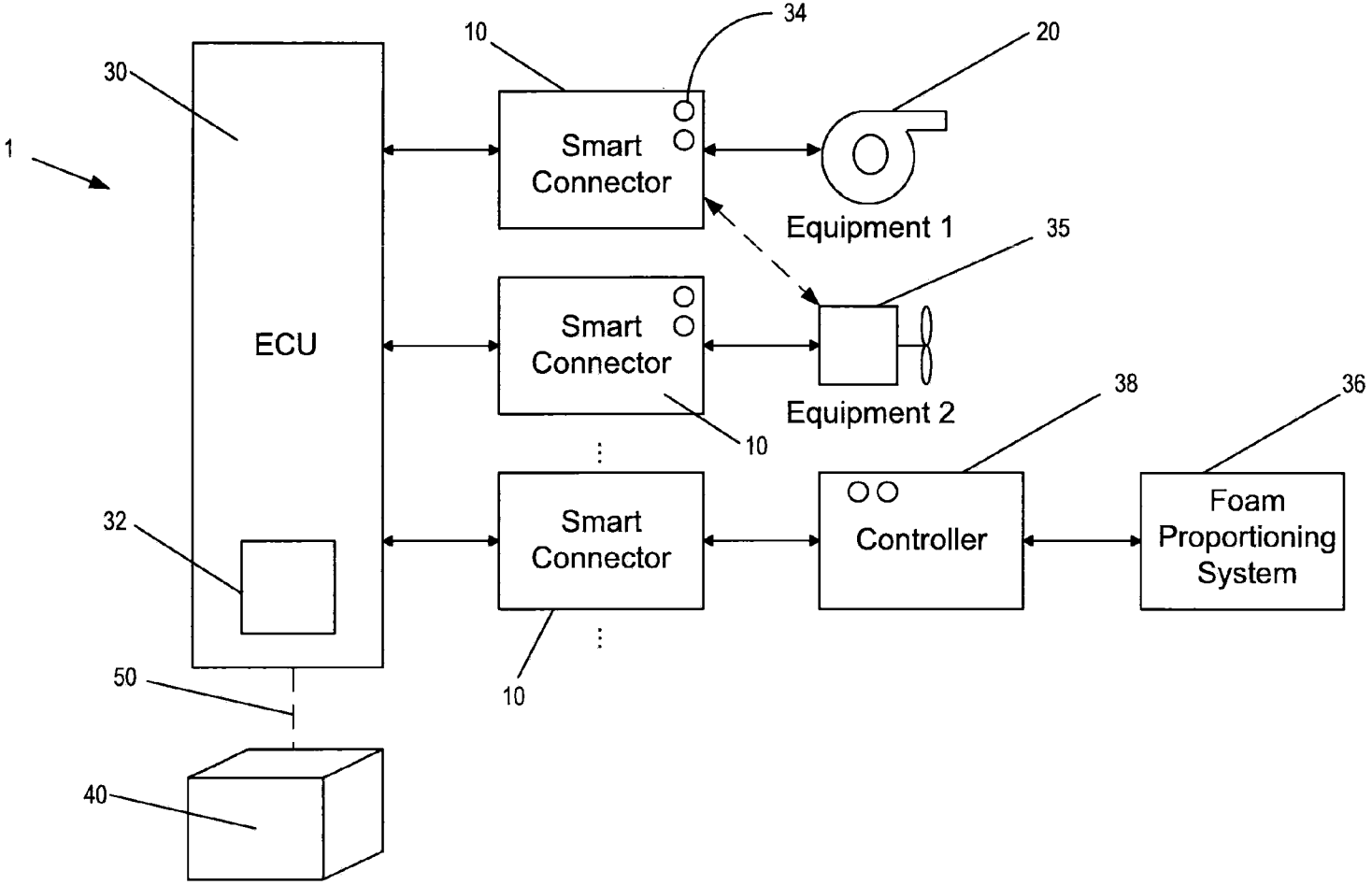
FIG. 1 is a schematic illustration of connections between an electronic control unit (ECU) and equipment using a smart connector according to one embodiment of the invention.

FIG. 1 illustrates a system 1 including one or more smart connectors 10 according to one embodiment of the invention. The system 1 can include the smart connectors 10, various equipment 20 and 35, and one or more electronic control units (ECU) 30. The smart connector 10 can connect the equipment 20 to the ECU 30. In some embodiments, the ECU 30 can include or comprise a programmable logic controller (PLC). The smart connector 10 can connect a foam proportioning system 36, including a controller 38, to the ECU 30. Additional equipment 35 can be connected to the same ECU 30 or a different type of controller with another smart connector 10. In one embodiment, each installed piece of equipment 20, 35 can be individually connected to the ECU 30 by a different smart connector 10, while in other embodiments, a single smart connector 10 can connect multiple pieces of equipment 20, 35 to the ECU 30. The smart connector 10 can be used for newly configured systems, as well as to upgrade existing systems.

During an authentication procedure, the ECU 30 can communicate with the smart connector 10. The authentication procedure can be used to identify the equipment 20, 35 that is being installed and/or to authorize its use. Upon successful completion of the authentication procedure, the ECU 30 can configure any necessary control software (e.g., software libraries) 32 to unlock functionality to control the equipment 20, 35. With the authentication procedure complete, the smart connector 10 can provide a fully functional connection for data and/or signal transfer to control the equipment 20, 35. The use of the smart connector 10 to connect the equipment 20, 35 with the ECU 30 can make the use of a separate computer 40 to configure the ECU 30 unnecessary (as indicated by dashed line 50).

The smart connector 10 can include one or more indicators 34, such as light emitting diodes (LEDs), to indicate status conditions. In one embodiment, the smart connector 10 can include a first LED to indicate if power is being supplied to the smart connector 10 and a second LED to indicate the status of the smart connector 10.

Figure 2:
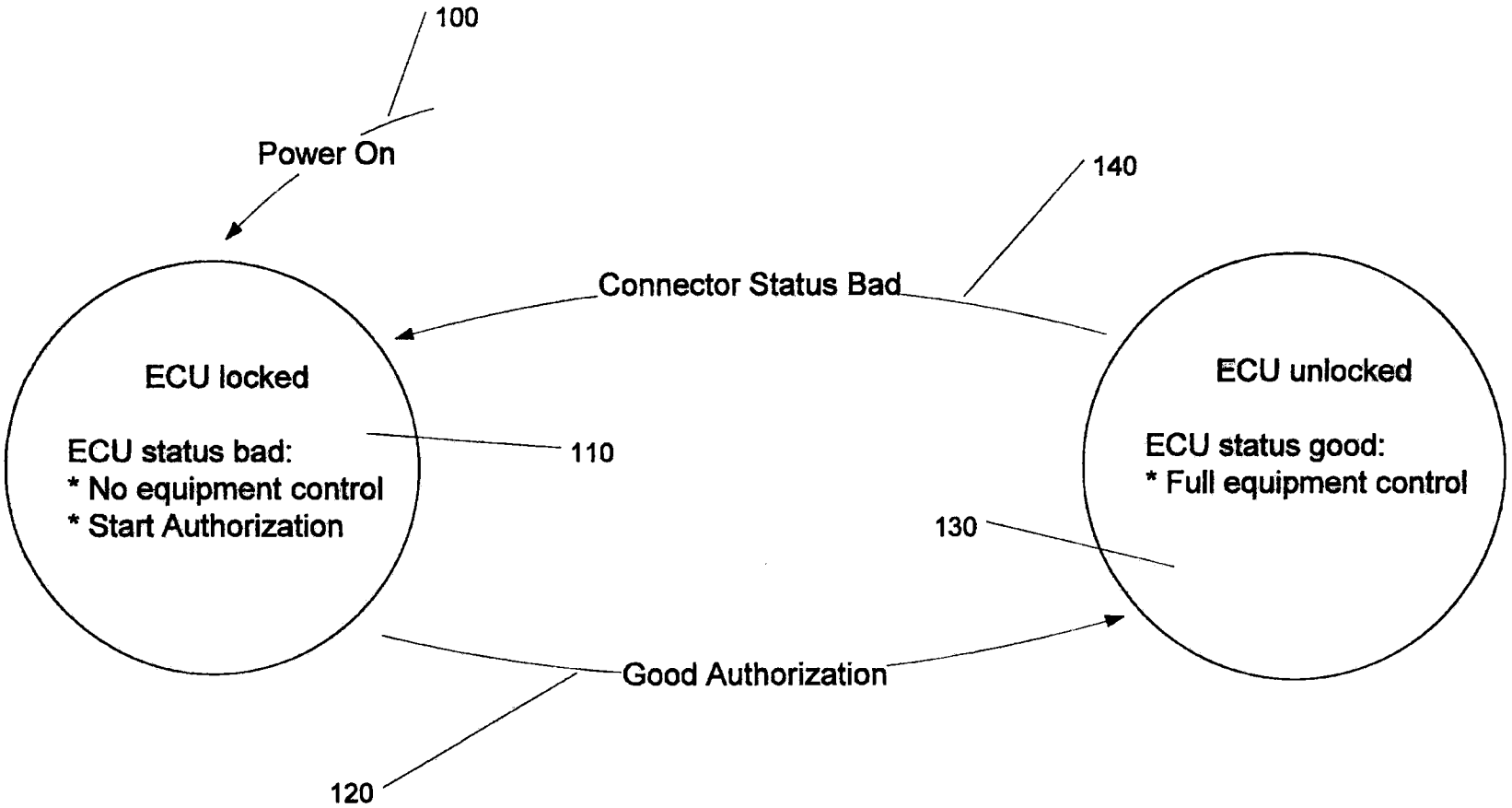
FIG. 2 is a state transition diagram of the ECU of FIG. 1.

FIG. 2 illustrates possible states of the ECU 30 according to one embodiment of the invention. When the system 1 is initially powered (at 100), the ECU 30 can be locked (at 110). A locked status of the ECU 30 means that certain features are unavailable, while an unlocked status can indicate additional or full functionality. In the locked state (at 110), the ECU 30 may not be able to control the equipment 20, 35. Although the locked ECU 30 can be unable to control the equipment 20, 35, other existing equipment can still be controlled by the ECU 30. If locked, the ECU 30 can initialize an authentication procedure in order to gain control of the equipment 20, 35. Upon a successful authentication (at 120), the ECU 30 can be unlocked (at 130) and control signals can be sent to the equipment 20, 35 via the smart connector 10. A bad connector status (at 140) of the smart connector 10 can return the ECU 30 into the locked state (at 110). Control signals can be stopped from being sent and the authentication procedure can be re-initialized.

Figure 3:
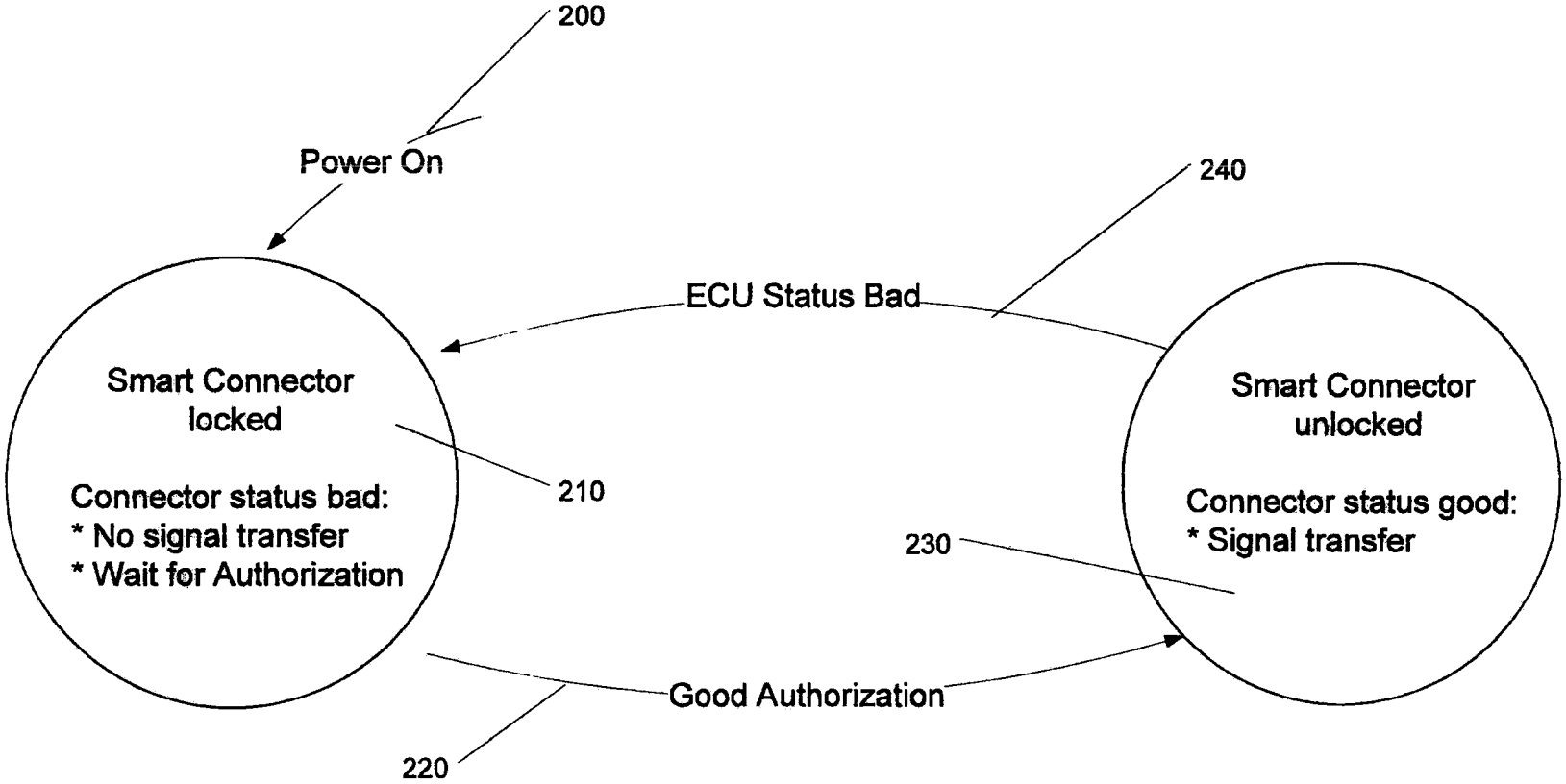
FIG. 3 is a state transition diagram of the smart connector of FIG. 1.

FIG. 3 illustrates possible states of the smart connector 10 according to one embodiment of the invention. After the system 1 is initially powered (at 200), the smart connector 10 can be locked (at 210). In the locked state (at 210), the smart connector 10 can block signal transfer to the equipment 20, 35. When locked, the smart connector 10 can wait for the ECU 30 to start the authentication procedure. Upon a successful authentication (at 220), the smart connector 10 can be unlocked (at 230). In the unlocked state (at 230), the smart connector 10 can allow the transfer of signals from the ECU 30 to control the equipment 20, 35. A bad status (at 240) of the ECU 30 can return the smart connector 10 to the locked state (at 210) and the signal transfer can be blocked again.

Figure 4:
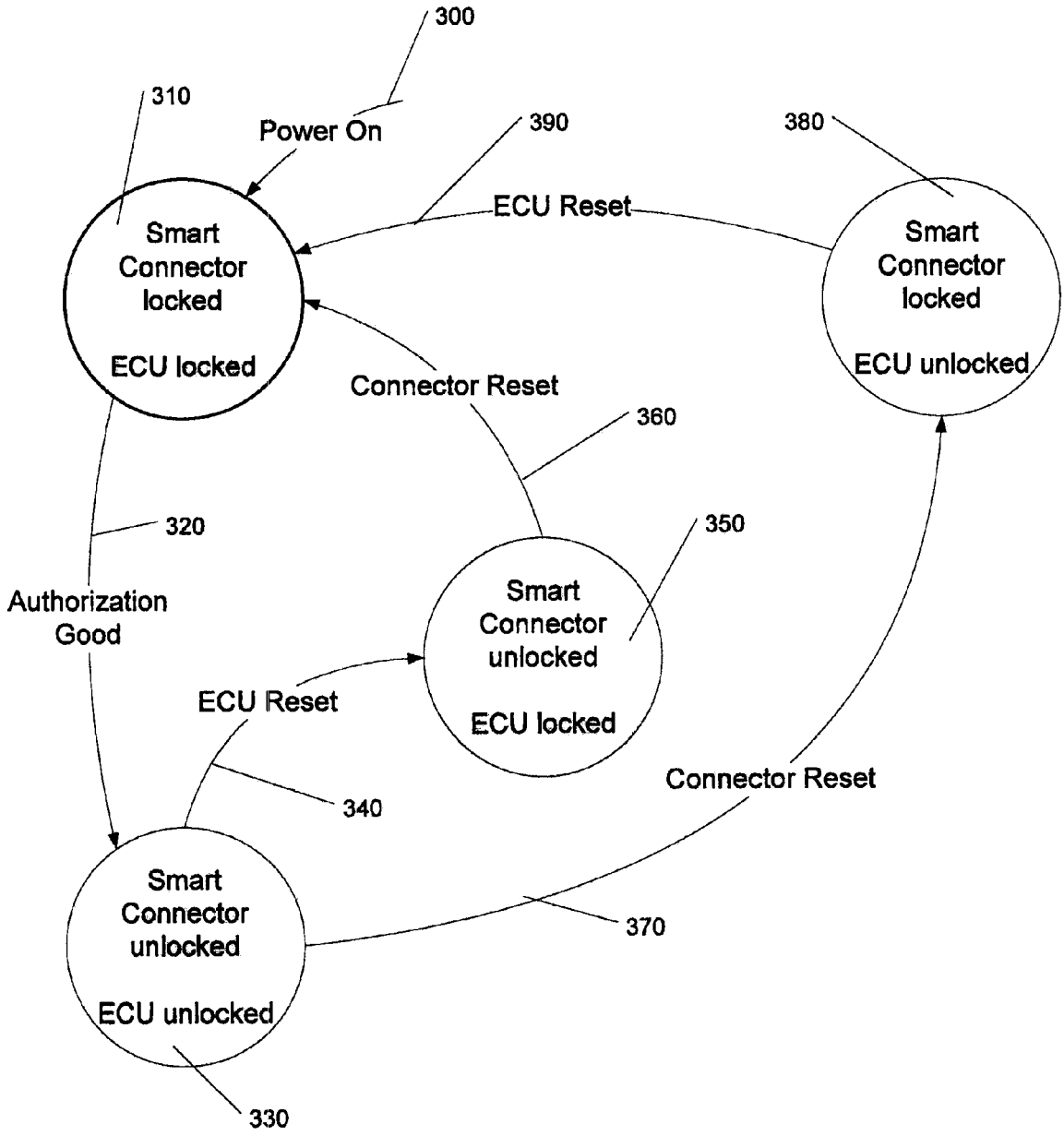
FIG. 4 is a state transition diagram of the ECU and the smart connector according to one embodiment of the invention.

FIG. 4 illustrates possible transitions between the different states of both the smart connector 10 and the ECU 30 according to one embodiment of the invention. After the system 1 is initially powered (at 300), the smart connector 10 and the ECU 30 can each be in their locked state (at 310). A successful authentication (at 320) can result in the smart connector 10 and the ECU 30 becoming unlocked (at 330). In some embodiments, the equipment 20, 35 can be fully operated by the ECU 30 only if both the smart connector 10 and the ECU 30 are unlocked. If the ECU 30 becomes unavailable, the ECU 30 can be reset (at 340) and can be locked, while the smart connector 10 can still be unlocked (at 350). Thereafter, the smart connector 10 can be reset (at 360) resulting in a locked status of the smart connector 10 and the ECU 30 (at 310). The authentication procedure can be restarted and can result in unlocking of the smart connector 10 and the ECU 30 (at 330). If the smart connector 10 becomes unavailable, the smart connector 10 can be reset (at 370) and can become locked, while the ECU 30 can still be unlocked (at 380). Thereafter, the ECU 30 can be reset (at 390), resulting in a locked status of the smart connector 10 and the ECU 30 (at 310). Thereafter, the authentication procedure can start over again.

Figure 5:
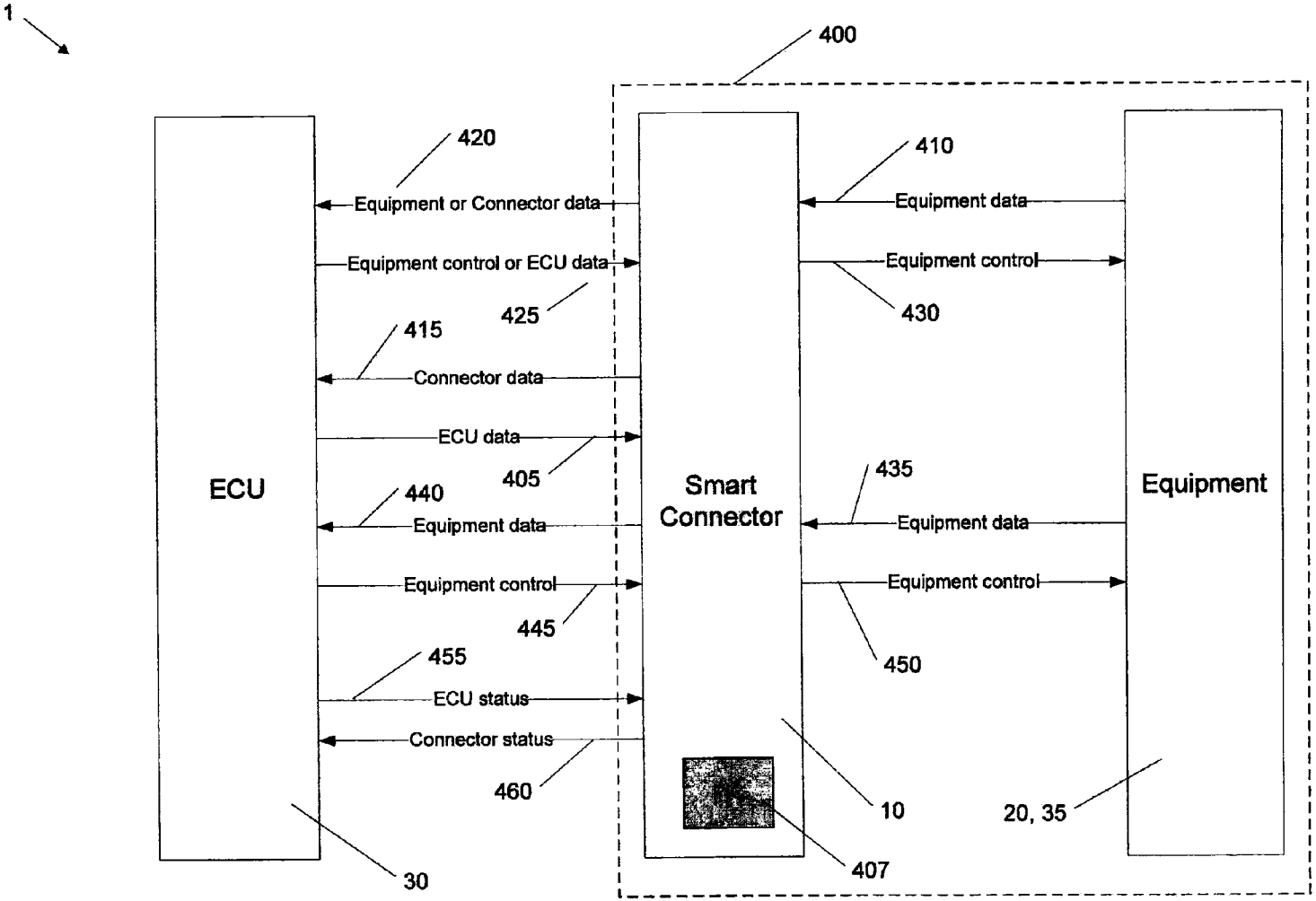
FIG. 5 is a block diagram illustrating signals being sent to and from the ECU, the smart connector, and the equipment according to one embodiment of the invention.

FIG. 5 illustrates possible types of signal transfers between the smart connector 10, the equipment 20, 35, and the ECU 30 according to some embodiments of the invention. A dashed box 400 around the smart connector 10 and the equipment 20, 35 can indicate that the smart connector 10 can be rigidly connected to or can be an integral part of the equipment 20, 35. This can allow the connection between the smart connector 10 and the ECU 30 to not only include suitable wired connections (e.g., CANbus, RS-485, Ethernet, and USB), but also wireless connections (e.g., IEEE 802.11-standard WLAN). For example, a CANbus connection is a high-integrity serial data communications bus. An open architecture and a user definable transmission string can make the CANbus adapt to different equipment. In one embodiment, the use of the CANbus connection can result in a flexible, reliable, and robust connection between the equipment 20, 35 and the ECU 30. The CANbus connection can provide signal transfer under extreme conditions, which can include high temperatures, wet environments, shock, vibrations, electro-magnetic interference (EMI), and elevated background noise.

As shown in FIG. 5, the ECU 30 can send ECU data via line 405 to the smart connector 10 to initialize the authentication procedure. The smart connector 10 can process the ECU data using a controller 407. In one embodiment, the controller is a micro-controller 407. The equipment 20, 35 can transfer information (e.g., equipment data) to the smart connector 10 via line 410, and a respective response (connector data) can be returned to the ECU 30 via line 415. The equipment data transferred to the smart connector 10 via line 410 can be repeatedly transmitted (e.g., every time the system 1 is powered). In one embodiment, the equipment data can be stored in the micro-controller 407. Additionally, the smart connector 10 can pass the equipment data from the equipment 20, 35 to the ECU 30 via line 420. Based on transmitted data, the ECU 30 can finalize the authentication procedure and can send control data to the smart connector 10 via line 425. The smart connector 10 can pass the control data to the equipment 20, 35 via line 430. A reply to the control data can be sent to the smart connector 10 via line 435, which in turn can pass the reply to the ECU 30 via line 440. The reply sent by the equipment 20, 35 can include a result from the control data (e.g., an indication that a solenoid valve is open, information about operating parameters, or the status of the equipment 20, 35). Using the smart connector 10, multiple connections between the equipment 20, 35 and the ECU 30 can be included for control data via line 445 and information transmittal via line 450. The data lines 410, 420, 425, 430, 435, 440, 445, and 450 can transfer different data simultaneously or certain data lines can be redundant to data lines. The ECU 30 can communicate its status to the smart connector 10 via line 455, while the smart connector 10 can communicate its status via line 460. If the smart connector 10 and/or the ECU 30 detects a bad status (i.e., becomes unavailable), the authentication procedure as described above can be initiated in an attempt to reach an unlocked status again.

FIG. 6 illustrates an electrical schematic for the smart connector 10 according to one embodiment of the invention. The smart connector 10 can include the micro-controller 407. In one embodiment, the micro-controller 407 can be an 8-bit programmable interface controller (PIC). The micro-controller 407 can include memory 600, for example, electrically erasable/programmable read-only memory (EEPROM). The memory 600 can store derivatives, which can be called during the authentication procedure. The memory 600 can be used for data storage. In some embodiments, the data being stored in the memory 600 can include a serial number of the equipment 20, 35, a configuration of the smart connector 10, a counter for the number of power cycles, and other information useful during the authentication procedure.

The smart connector 10 can include or can be connected to a physical bus connector 602 including several power and communication lines, such as a voltage line 604, a system control language (SCL) line 606, a static data authentication (SDA) line 608, a ground line 610, and a device/equipment control line 612. The voltage line 604 can be connected in series to a diode D1 and a resistor $R_{IN}$, which can be connected to a capacitor C1. The SCL line 606 can be connected in series to a resistor R1, which can be connected to the micro-controller 407. The SDA line 608 can be connected in series to a resistor R2, which can be connected to the micro-controller 407. The ground line 610 can be used to ground the smart connector 10. The device/equipment control line 612 can pass through the smart connector 10 and continue to the equipment 20, 35. In some embodiments, the device/equipment control line 612 provides a CANbus connection to the equipment 20, 35.

Figure 7:
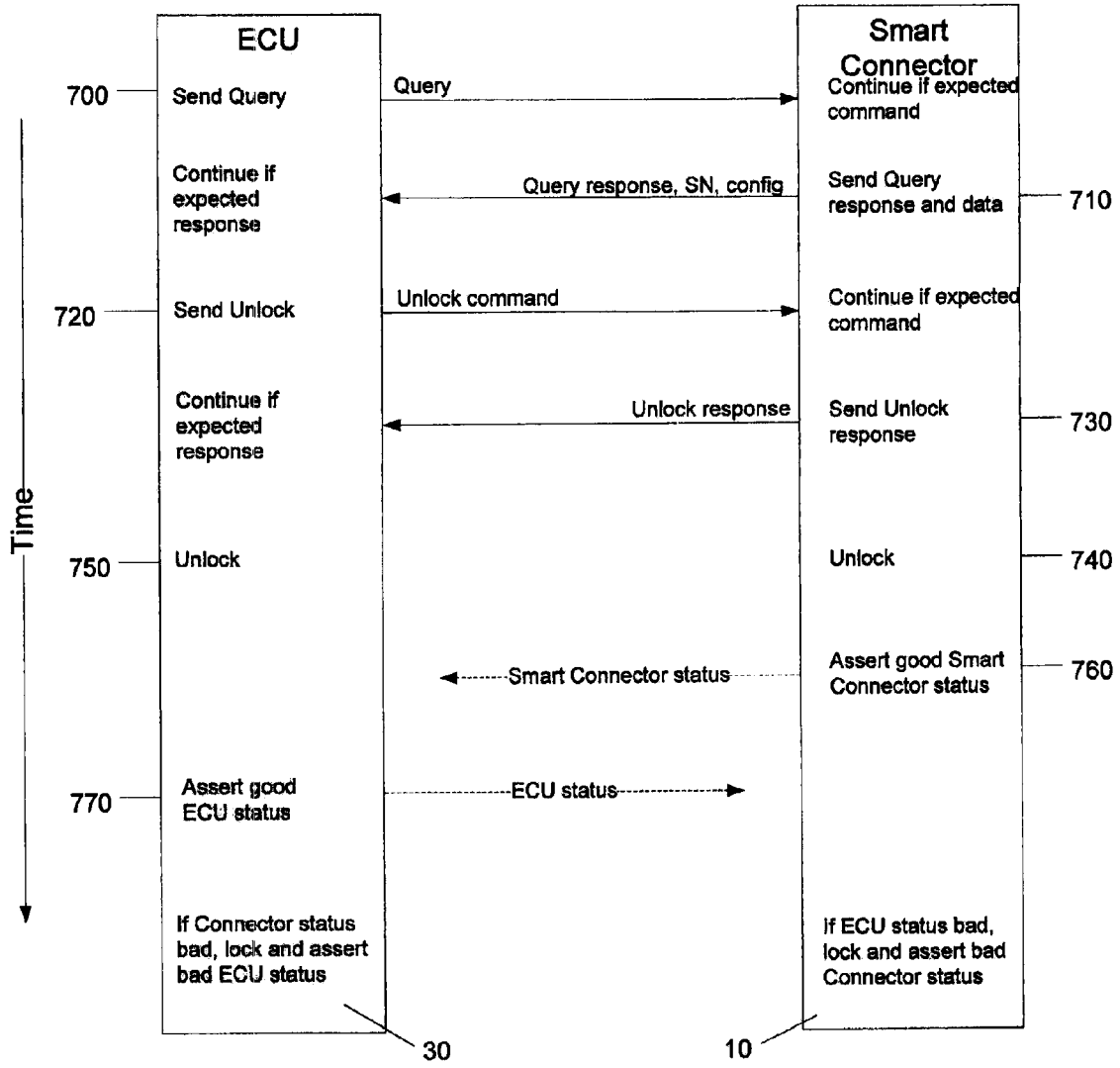
FIG. 7 is a diagram of a temporal sequence of an authentication procedure of the ECU and the smart connector according to one embodiment of the invention.

FIG. 7 illustrates a temporal sequence of an authentication procedure according to one embodiment of the invention. The ECU 30 can send a query to the smart connector 10 (at 700). If the query sent by the ECU 30 is valid and/or expected, the smart connector 10 can send a response including the authorization procedure and information about the configuration of the equipment 20, 35 back to the ECU 30 (at 710). The response can be used to identify the equipment 20, 35. If the response from the smart connector 10 is valid and/or expected, the ECU 30 can send an unlock command (at 720). The smart connector 10 can process the unlock command and can send an unlock response in return (at 730) before setting an unlock status (at 740). Depending on the unlock response from the smart connector 10, the ECU 30 can be unlocked (at 750) and can enter an additional or full-functionality mode. Thereafter, control data and information can be exchanged between the ECU 30 and the equipment 20, 35 through the smart connector 10, while the status of the smart connector 10 (at 760) and the status of the ECU 30 (at 770) can be determined frequently or periodically. The control data and information exchange can be limited to times when both the smart connector 10 and the ECU 30 are unlocked. At any time, if the smart connector 10 or the ECU 30 becomes unavailable, the control data and information exchange can be terminated. The smart connector 10 can also initiate the authentication procedure as described above.

Figure 8:
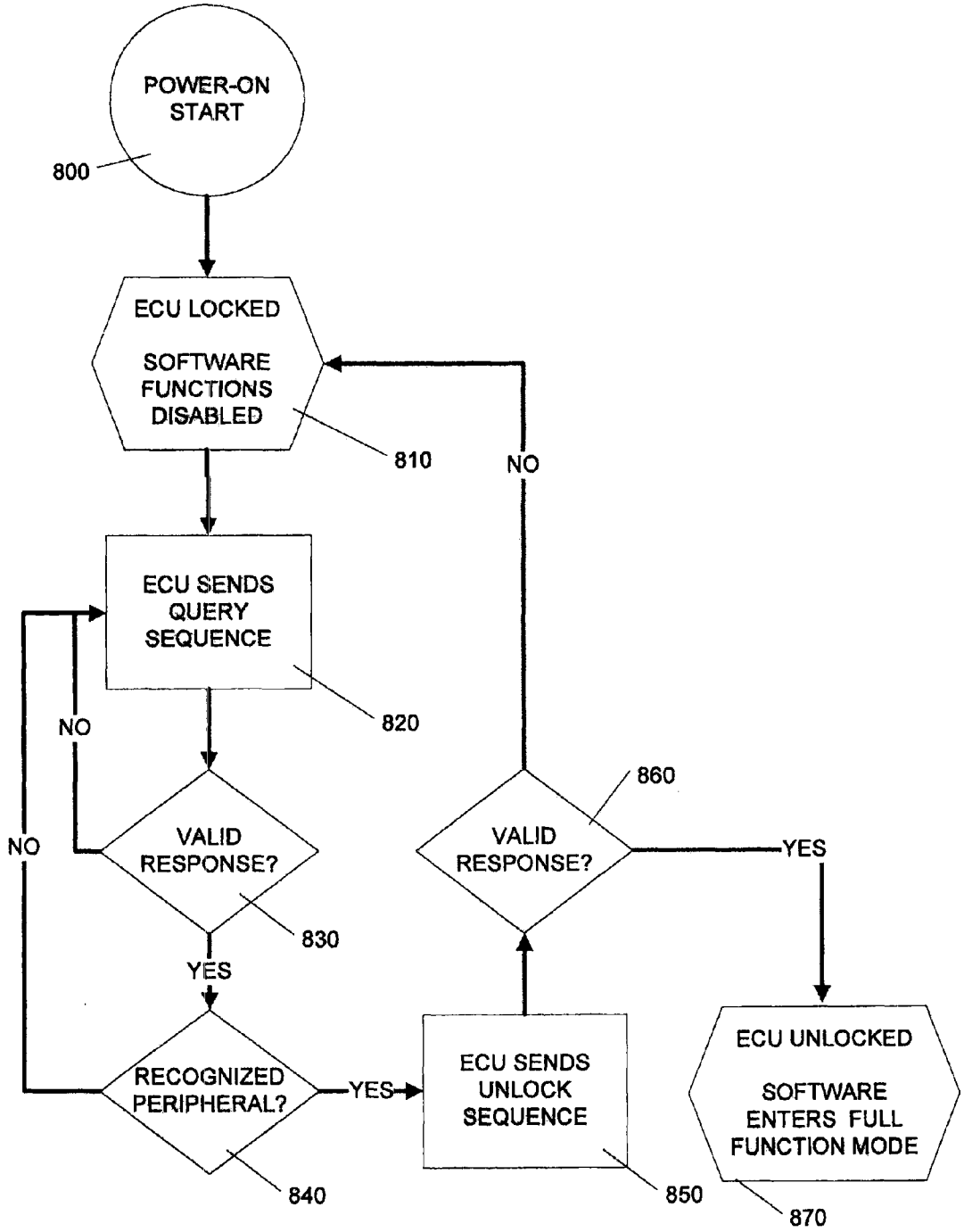
FIG. 8 is a flow chart of the authentication procedure of FIG. 7.

FIG. 8 illustrates a flow chart of the authentication procedure for the ECU 30 according to one embodiment of the invention. The ECU 30 can be turned on (at 800). Upon start-up, the ECU 30 can enter its locked state (at 810), which can disable some or all of the functionality of the ECU 30. The ECU 30 can send (at 820) a query to the smart connector 10. If an invalid response is received by the ECU 30 (at 830), the ECU 30 can resend the query (at 820). If the response from the smart connector 10 can be processed, the ECU 30 can identify the installed peripheral equipment 20, 35. If the equipment 20, 35 cannot be recognized (at 840), the ECU 30 can return to sending another query (at 820). If the ECU 30 recognizes the equipment 20, 35 (at 840), the ECU 30 can send an unlock sequence (at 850). After the ECU 30 has received a valid response from the smart connector 10 (at 860), the status of ECU 30 can become unlocked and the ECU 30 can enable full functionality (at 870). If no valid response is received by the ECU 30 (at 860), the ECU 30 can stay in its locked status and re-initialize the authentication process (at 810).

Some embodiments of the invention can be used to connect the foam proportioning system 36 to an ECU 30 of a fire truck or other fire extinguishing equipment. One example of a suitable foam proportioning system is disclosed in co-pending, commonly-assigned U.S. patent application Ser. Nos. 12/555,714; 12/555,698; and 12/555,705; the entire contents of which are herein incorporated by reference. After the hardware of the foam proportioning system 36 is installed, the ECU 30 of the fire truck can be updated with a software library 32 (as disclosed in co-pending, commonly-assigned U.S. patent application Ser. No. 12/234,625, the entire contents of which is herein incorporated by reference). The updated software library can be used to control the new foam proportioning system. The smart connector 10 can be used to connect the controller 38 of the foam proportioning system 36 to the ECU of the fire truck to complete the installation process (see FIG. 1). Since the smart connector 10 can allow for an automatic authentication of the installed foam proportioning system, no further configuration is necessary for the entire system to reach full functionality. Based on the information provided by the smart connector 10 and/or the controller of the foam proportioning system during the authentication procedure, the software library in the ECU can be configured to allow the ECU of the fire truck to control the foam proportioning system.

In one embodiment, the authentication procedure can include an authorization process and an identification process. The authorization process can include information about the manufacturer, model, and serial number of the foam proportioning system. The identification process can include information about the configuration of the foam proportioning system, which can include the number of pumps, the number of supply tanks, what type of foam pumps are installed, etc. In general, the smart connector 10 can perform the following functions: recognize when new equipment is connected, verify authorization, identify the new equipment, and unlock software functionality of the software library to enable control of the new equipment.

In some embodiments, the software library 32 can include additional routines, that are not currently being used, but may be used later if the equipment configuration is upgraded or changed. When the equipment is upgraded, the software library does not need to be updated because the routines are already included in the software library that was originally installed in the ECU 30. For example, a foam portioning system may be initially installed with only one foamant supply tank on a fire truck. When the foam proportioning system is later upgraded to include two foamant supply tanks, the software library does not need to be updated. Rather, the smart connector 10 can communicate to the ECU 30 of the fire truck that two foamant supply tanks are now being used. The routines designed for a configuration with two foamant supply tanks (which were included in the software library that was originally installed in the ECU 30 of the fire truck) are automatically unlocked by using the smart connector 10. In this manner, the ECU 30 is able to properly control the new configuration of the foam proportioning system without having to manually upgrade and debug the software libraries of the fire truck's ECU 30.

It will be appreciated by those skilled in the art that while the invention has been described above in connection with particular embodiments and examples, the invention is not necessarily so limited, and that numerous other embodiments, examples, uses, modifications and departures from the embodiments, examples and uses are intended to be encompassed by the claims attached hereto. The entire disclosure of each patent and publication cited herein is incorporated by reference, as if each such patent or publication were individually incorporated by reference herein. Various features and advantages of the invention are set forth in the following claims.

The invention claimed is:

1. A method of installing a foam proportioning system in a fire extinguishing system, the fire extinguishing system including an electronic control unit and a software library, the method comprising:

connecting a smart connector to the electronic control unit;

sending a query from the electronic control unit to the smart connector;

sending a response to the query from the smart connector to the electronic control unit including an authorization procedure and configuration data for the foam proportioning system;

identifying the foam proportioning system with the electronic control unit based on the response;

sending an unlock command from the electronic control unit to the smart connector if the response is valid;

processing the unlock command with the smart connector;

sending an unlock response and an unlock status from the smart connector to the electronic control unit;

unlocking at least a portion of the software library in the electronic control unit.

2. The method of claim 1, and further comprising transmitting control data from the electronic control unit to the foam proportioning system through the smart connector after unlocking the software library.

3. The method of claim 2, wherein the fire extinguishing system includes a fire truck, and further comprising controlling the foam proportioning system with the electronic control unit of the fire truck.

4. The method of claim 1, wherein the authorization procedure includes sending at least one of a serial number, a model number, a manufacturer, configuration data, and a power cycle counter.

5. The method of claim 1, and further comprising connecting the fire extinguishing equipment to the foam proportioning system using a CANbus connection through the smart connector.

6. The method of claim 1, wherein the electronic control unit is a programmable logic controller.

7. The method of claim 1, wherein the smart connector includes a micro-controller that is a programmable interface controller.

8. The method of claim 1, and further comprising storing in memory of the smart connector at least one of a serial number, a model number, a manufacturer, configuration data, and a counter for storing a number of power cycles.

9. The method of claim 8, and further comprising performing the authorization process using data stored in the memory.

10. The method of claim 1, and further comprising performing an identification process with the smart connector in which at least one of a number of pumps, a number of supply tanks, and a type of foam pump are identified.

11. The method of claim 1, and further comprising indicating with at least one light-emitting diode on the smart connector at least one of whether power is being supplied to the smart connector and a status of the smart connector.

12. The method of claim 1, wherein the foam proportioning system includes a controller, and further comprising connecting the smart connector to the controller and the electronic control unit.

* * * * *